US007602161B2

(12) United States Patent
McLeod

(10) Patent No.: US 7,602,161 B2
(45) Date of Patent: Oct. 13, 2009

(54) VOLTAGE REGULATOR WITH INHERENT VOLTAGE CLAMPING

(75) Inventor: Scott C. McLeod, Oro Valley, AZ (US)

(73) Assignee: Standard Microsystems Corporation, Hauppauge, NY (US)

( * ) Notice: Subject to any disclaimer, the term of this patent is extended or adjusted under 35 U.S.C. 154(b) by 11 days.

(21) Appl. No.: 11/429,098

(22) Filed: May 5, 2006

(65) Prior Publication Data

US 2007/0257644 A1 Nov. 8, 2007

(51) Int. Cl.
*G05F 1/00* (2006.01)
*G05F 3/16* (2006.01)

(52) U.S. Cl. ..... 323/273; 323/282; 323/313

(58) Field of Classification Search ..... 323/282, 323/313, 286, 314, 273, 274, 275; 327/536, 327/539, 540, 541, 542
See application file for complete search history.

(56) References Cited

U.S. PATENT DOCUMENTS 5,105,102 A * 4/1992 Shioda ..... 326/73
5,506,496 A * 4/1996 Wrathall et al. ..... 323/316
5,539,603 A * 7/1996 Bingham ..... 361/56
5,559,425 A * 9/1996 Allman ..... 323/315
5,642,033 A * 6/1997 Bartol et al. ..... 322/25
5,694,031 A * 12/1997 Stanojevic ..... 323/313
6,184,667 B1 * 2/2001 Lacey ..... 323/282
6,188,212 B1 * 2/2001 Larson et al. ..... 323/281
6,201,375 B1 * 3/2001 Larson et al. ..... 323/277
6,208,123 B1 3/2001 Sudo
6,265,856 B1 * 7/2001 Cali' et al. ..... 323/273
6,300,749 B1 * 10/2001 Castelli et al. ..... 323/273
6,507,174 B1 1/2003 Qian
6,614,280 B1 * 9/2003 Panwitz ..... 327/307
6,759,835 B2 * 7/2004 Turvey et al. ..... 323/282
6,861,831 B2 3/2005 Ngiap Ho
7,030,598 B1 * 4/2006 Dow ..... 323/313
2004/0212429 A1 * 10/2004 Gupta et al. ..... 330/257

* cited by examiner

*Primary Examiner*—Akm E Ullah
*Assistant Examiner*—M'Baye Diao
(74) *Attorney, Agent, or Firm*—Meyertons Hood Kivlin Kowert & Goetzel, P.C.; Jeffrey C. Hood

(57) ABSTRACT

A voltage regulator may include a resistor-based voltage divider circuit generating a desired output voltage from a supply voltage, an output NMOS device whose source terminal may be configured as the output of the voltage regulator and whose drain terminal may be configured to receive the supply voltage, and a control circuit configured to control the output NMOS device to maintain the desired output voltage at the output of the voltage regulator. The control circuit may be configured to receive the desired output voltage from the voltage divider circuit as a first input, and to receive the output of the voltage regulator fed back as a second input to form a feedback loop. The control circuit may control the gate of the output NMOS device via the feedback loop to adjust the output of the voltage regulator by maintaining the desired output voltage at the source of the output NMOS device, and may also clamp the output of the voltage regulator to a specified voltage that is lower than the supply voltage, without requiring a second feedback loop.

25 Claims, 2 Drawing Sheets

VOLTAGE REGULATOR WITH INHERENT VOLTAGE CLAMPING

BACKGROUND OF THE INVENTION

1. Field of the Invention

This invention relates generally to the field of integrated circuit design and, more particularly, to the design of voltage regulator circuits.

2. Description of the Related Art

Voltage regulators are electrical regulators generally designed to automatically maintain constant voltage levels, and may operate according to electromechanical principles, or by using passive/active electronic components. In some designs, voltage regulators may be used to regulate one or more AC and/or DC voltages, performing the voltage regulation by comparing an actual output voltage to some internal fixed reference voltage. The difference between the voltages is typically amplified and used as a control signal into a control circuit configured to maintain a substantially constant output voltage, essentially forming a negative feedback control loop. If the output voltage is too low, the control circuit operates to generate a higher voltage. If the output voltage is too high, the control circuit operates to generate a lower voltage. This allows the output voltage to remain essentially constant. In most cases the control loop has to be carefully designed in order to obtain the desired tradeoff between response speed and stability.

Electronic linear voltage regulators are often based on an active device, such as a bipolar junction transistor or field effect transistor, operating in its "linear region", or based on passive devices, such as zener diodes, operated in their breakdown region. Switching regulators are typically based on a transistor forced to act as an on/off switch. The transistor (or other active device) is typically used as one half of a potential voltage divider to control the output voltage of the regulator, with a feedback circuit comparing the output voltage to a reference voltage in order to adjust the input to the transistor, thus keeping the output voltage essentially constant. Many times voltage regulators are used to enable circuits/systems to operate using only one supply voltage, with the voltage regulator(s) providing various subcircuits and/or subsystems with different individual supply voltages.

In some systems it may be desirable to provide a regulated voltage that is not prone to producing over-voltage damage, without the requirement of an external bypass capacitor to clamp the voltage. In case a very small average load current is required, it may be more advantageous to handle large current spikes with only on chip capacitance, and in a very small area. A typical low dropout regulator may present a potential problem of producing an over-voltage of the regulated output. In order to avoid this problem, a voltage regulator is typically configured with secondary feedback loops that are used to clamp the output voltage. This generally presents complex design issues, since at some point during operation two feedback loops will be trying to control the regulated output voltage.

Other corresponding issues related to the prior art will become apparent to one skilled in the art after comparing such prior art with the present invention as described herein.

SUMMARY OF THE INVENTION

In one set of embodiments a voltage regulator may include a resistor-based voltage divider circuit to generate a desired output voltage from a higher supply voltage, an output NMOS device whose source terminal may be configured as the output of the voltage regulator and whose drain terminal may be configured to receive the supply voltage, and a control circuit configured to control the output NMOS device to maintain the desired output voltage at the output of the voltage regulator. The control circuit may be configured to receive the desired output voltage from the resistor-based voltage divider circuit as a first input, and may also be configured to receive the output of the voltage regulator fed back as a second input, to form a feedback loop. The control circuit may control the gate voltage of the output NMOS device via the feedback loop to maintain the desired output voltage at the source terminal of the output NMOS device, thereby adjusting the output of the voltage regulator. In addition, the control circuit may also clamp the output of the voltage regulator to an intermediate voltage that is lower than the supply voltage and higher than the desired output voltage, without requiring a secondary feedback loop or external clamping capacitors.

In one set of embodiments, the voltage divider circuit may comprise three series-coupled resistors configured to provide the desired output voltage at a first node, and provide an intermediate voltage at a second node, where the intermediate voltage is higher than the desired output voltage but lower then the supply voltage. The control circuit may include an operational transconductance amplifier (OTA), configured to receive the desired output voltage (from the first node) at its inverting terminal. The control circuit may also include a pair of NMOS devices (top and bottom device) coupled to form an inverting amplifier, with the drain of the top device coupled to the supply voltage, and the source of the bottom device coupled to ground. The input of the inverting amplifier (gate of the bottom device) may be driven by the output of the OTA, while the gate of the top device may be configured to receive the intermediate voltage (from the second node), and the output (the node formed by the source of the top device coupled to the drain of the bottom device) configured to control the gate of the output NMOS device.

The top device may be a native NMOS device, resulting in the voltage at its source terminal being approximately equal to its gate voltage when the top device is conducting a small current. As a result, when the top device is conducting a very low current, no current may flow from its gate terminal into the second node, effectively clamping the output voltage (at the source of the output NMOS device) to the intermediate voltage. The source terminal of the output NMOS device may be coupled to the non-inverting input of the OTA, thereby creating feedback loop control. As part of the OTA controlling the gate of the bottom device (of the inverting amplifier), when the gate voltage of the bottom device increases, the source voltage of the top device may decrease, resulting in control of the gate of the output NMOS device, and hence the source voltage of the output NMOS device. The output of the voltage regulator may thereby be controlled to remain at the desired output voltage.

Thus, various embodiments of the invention may provide a means for designing and building a reliable integrated voltage regulator circuit with inherent clamping that doesn't require secondary feedback loops or external clamping capacitors, and has a compact and small area.

BRIEF DESCRIPTION OF THE DRAWINGS

The foregoing, as well as other objects, features, and advantages of this invention may be more completely understood by reference to the following detailed description when read together with the accompanying drawings in which.

Figure 1:
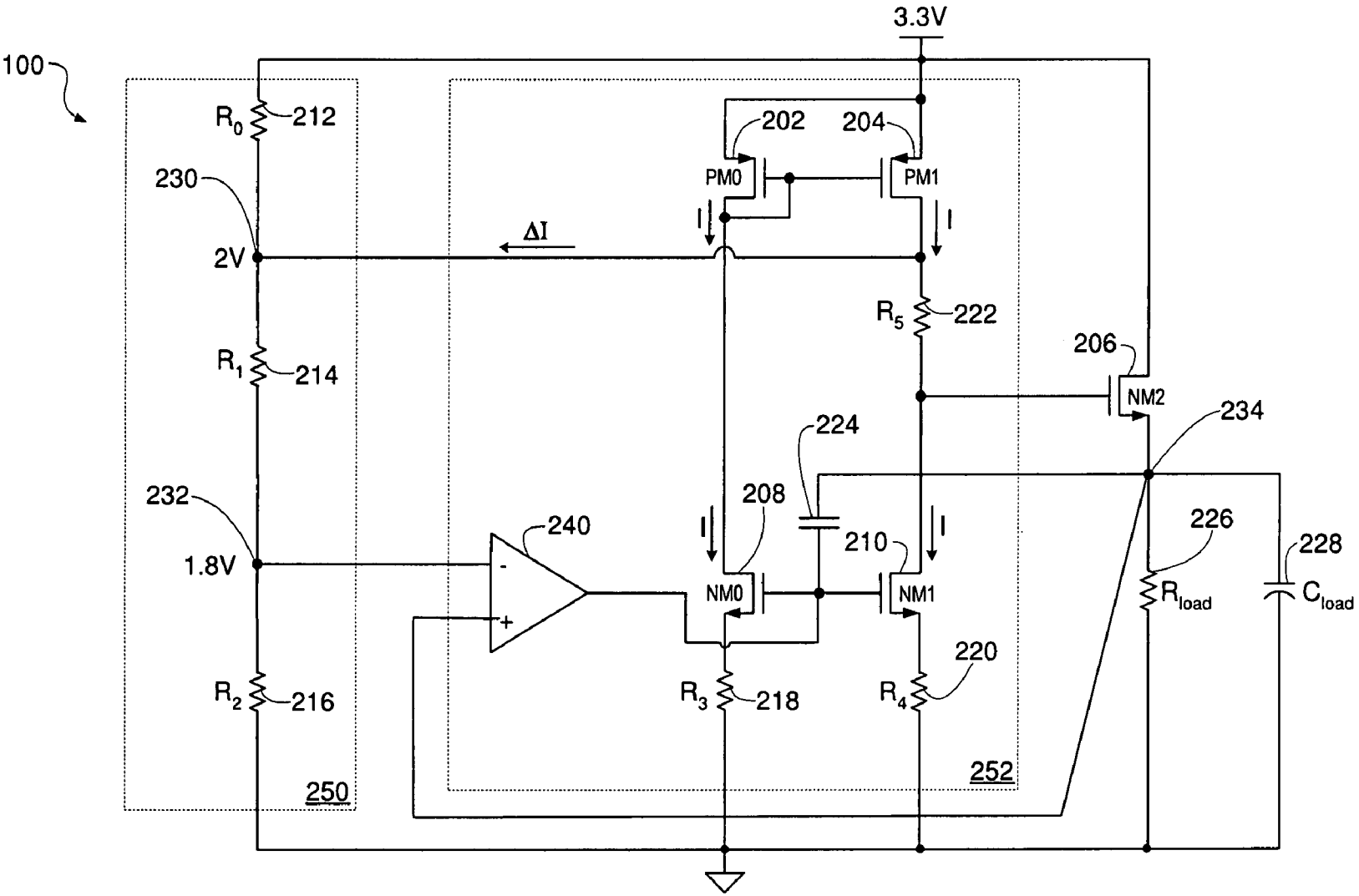
FIG. 1 shows one embodiment of a voltage regulator with inherent clamping.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents, and alternatives falling within the spirit and scope of the present invention as defined by the appended claims. Note, the headings are for organizational purposes only and are not meant to be used to limit or interpret the description or claims. Furthermore, note that the word "may" is used throughout this application in a permissive sense (i.e., having the potential to, being able to), not a mandatory sense (i.e., must)." The term "include", and derivations thereof, mean "including, but not limited to". The term "coupled" means "directly or indirectly connected".

DETAILED DESCRIPTION OF THE PREFERRED EMBODIMENTS

FIG. 1 shows one embodiment of a compact voltage regulator circuit 100 with inherent clamping. Voltage regulator circuit 100 may be used to provide a regulated secondary supply voltage from a primary voltage supply in a system that comprises partitions requiring two different supply voltages, thereby obviating the need for a second voltage supply. For example, a temperature sensor system may require a 3.3V supply voltage, while the monitored circuit(s) may comprise transistor devices operating from a 1.8V supply voltage. By way of example, voltage regulator circuit 100 is shown to operate from a primary supply voltage of 3.3V in order to provide a regulated 1.8V secondary supply voltage at node 234, and comprises a voltage divider circuit 250 and a control circuit 252, driving output transistor 206. Alternate embodiments may be configured with different primary voltage values for providing one of any number of different regulated secondary supply voltages as required by any given system.

As shown in FIG. 1, a voltage divider circuit 250 comprising resistors $R_0$ 212, $R_1$ 214 and $R_2$ 216 may be configured to provide a lower voltage (1.8V in this example) at node 232 from a higher supply voltage (3.3V in this example) obtained from a voltage supply. In one embodiment, control circuit 252 comprises amplifier 240, which may be an operational transconductance amplifier (OTA), configured to receive the lower voltage from node 232 at its inverting terminal, and drive the respective gates of NMOS devices 208 and 210 through its output. In one set of embodiments, NMOS devices 208 and 210 are identical, and resistors $R_3$ 218 and $R_4$ 220 are also identical, resulting in identical currents (shown as current 'I') being conducted by both NMOS device 208 and NMOS device 210. The current flowing through NMOS device 208 may be drawn from PMOS device 202, with the source of PMOS device 202 coupled to the drain of NMOS device 208. PMOS device 204 may be configured to mirror the current flowing through PMOS device 202, resulting in current 'I' also being conducted by PMOS device 204. Since the current conducted by PMOS device 202 may essentially be the same as the current conducted by PMOS device 204, ΔI shown flowing into node 230 may be close to zero. As a result of the value of ΔI being zero, the voltage at the drain of PMOS device 204 may be clamped at the same voltage level as the voltage developed at node 230 (in this case, 2V). Those skilled in the art will appreciate that the value of an equivalent mirror current may typically be within 1% of the value of the mirrored current, and that various techniques may be employed to minimize or eliminate mismatch errors between PMOS devices 202 and 204. Such mismatch errors may be present due to fabrication process variations, for example, and may be remedied using well known methods in the art, e.g. dynamic element matching (DEM).

Considering now NMOS devices 208 and 210, if the magnitude of the voltage at the respective gates of NMOS devices 208 and 210 increases, the value of current 'I' may also increase. However, the value of current 'I' may not reach a negative value. Accordingly, the gate terminal of NMOS device 206, which is configured as the output transistor, may also not exceed the voltage corresponding to the level set at node 230, and may only decrease as the value of 'I' increases. In one embodiment, NMOS device 206 is a native device with a threshold voltage of approximately zero volts, resulting in the voltage regulator output node 234 also being clamped at approximately the same voltage level as the one set at node 230. This may protect digital gates operating from a supply voltage provided by voltage regulator circuit 100, since the voltage provided by voltage regulator circuit 100 will not exceed the corresponding voltage set at node 230.

Regulation of the output voltage at node 234 may be accomplished using a feedback loop created by coupling the output (node 234) of voltage converter circuit 100 to the non-inverting input of OTA 240 as shown. By driving the gates of NMOS devices 208 and 210, OTA 240 may operate to adjust the output voltage at node 234, maintaining the output voltage at a level matching the voltage applied to the inverting input of OTA 240. Capacitive load 228 and resistive load 226 represent loads for which voltage regulator 100 may provide a supply voltage. Thus, capacitive load 228 may represent the capacitance of a digital block or circuit driven by voltage regulator 100. Alternatively, 2V MOS devices may be configured as capacitors on-chip, and coupled to output node 234. As an example, with a small number of digital gates coupling to node 234, 1000 pF of MOS capacitance may constitute a sufficient capacitive load. Additional consideration may also be given to how the output of voltage regulator 100 is clamped at node 234. Those skilled in the art will appreciate that even when NMOS device 206 is a native device, while conducting larger currents the threshold voltage of NMOS device 206 may increase to a small nominal value, generally under 200 mV. Therefore, it may be desirable to have the voltage at the drain terminal of PMOS device 204, and consequently at the gate terminal of NMOS device 206, clamped to a value slightly higher than the desired output voltage (e.g. 1.8V, in this case).

In voltage regulator 100 shown in FIG. 1, this issue is addressed by configuring voltage divider circuit with resistors $R_0$ 212, $R_1$ 214 and $R_2$ 216 to provide, from the higher supply voltage, a lower voltage (again, 1.8V in this example) at node 232, and also an intermediate voltage value at node 230. The voltage at node 230 may be slightly higher (in this case 2V) than the magnitude of the desired output voltage represented at node 232. As described above, amplifier 240 may be configured to receive the voltage corresponding to the desired output voltage value from node 232 at its inverting terminal, and drive the gate terminals of NMOS devices 208 and 210 through its output. The voltage developed at node 230 may be provided at the drain of PMOS device 204. Due to the value of ΔI being zero, as previously described, the voltage at node 230 may be unaffected by ΔI, therefore remaining at 2V, and leading to the output voltage at node 234 being clamped to the deterministic value of the voltage developed at node 230 (in this example 2V). By coupling a voltage slightly higher than the regulated output voltage to the drain of PMOS device 204, the voltage value at which the output at node 234 will be clamped may be slightly higher than the value of the regulated output voltage, but not less.

Those skilled in the art will appreciate that this additional feature, while beneficial, may not be necessary, and alternate embodiments in which voltage divider 250 comprises node 232 but not node 230, with node 232 coupled to the drain of PMOS device 204 are possible and are contemplated. In such embodiments the output at node 234 would be clamped at the regulated output value corresponding to the voltage developed at node 232. As also shown in FIG. 1, control circuit 252 is configured with a capacitor 224 coupled between the output of amplifier 240 and output node 234 to reduce and/or eliminate oscillations that may develop resulting from the feedback loop. Alternate embodiments without capacitor 224 are also possible and are contemplated.

Figure 2:
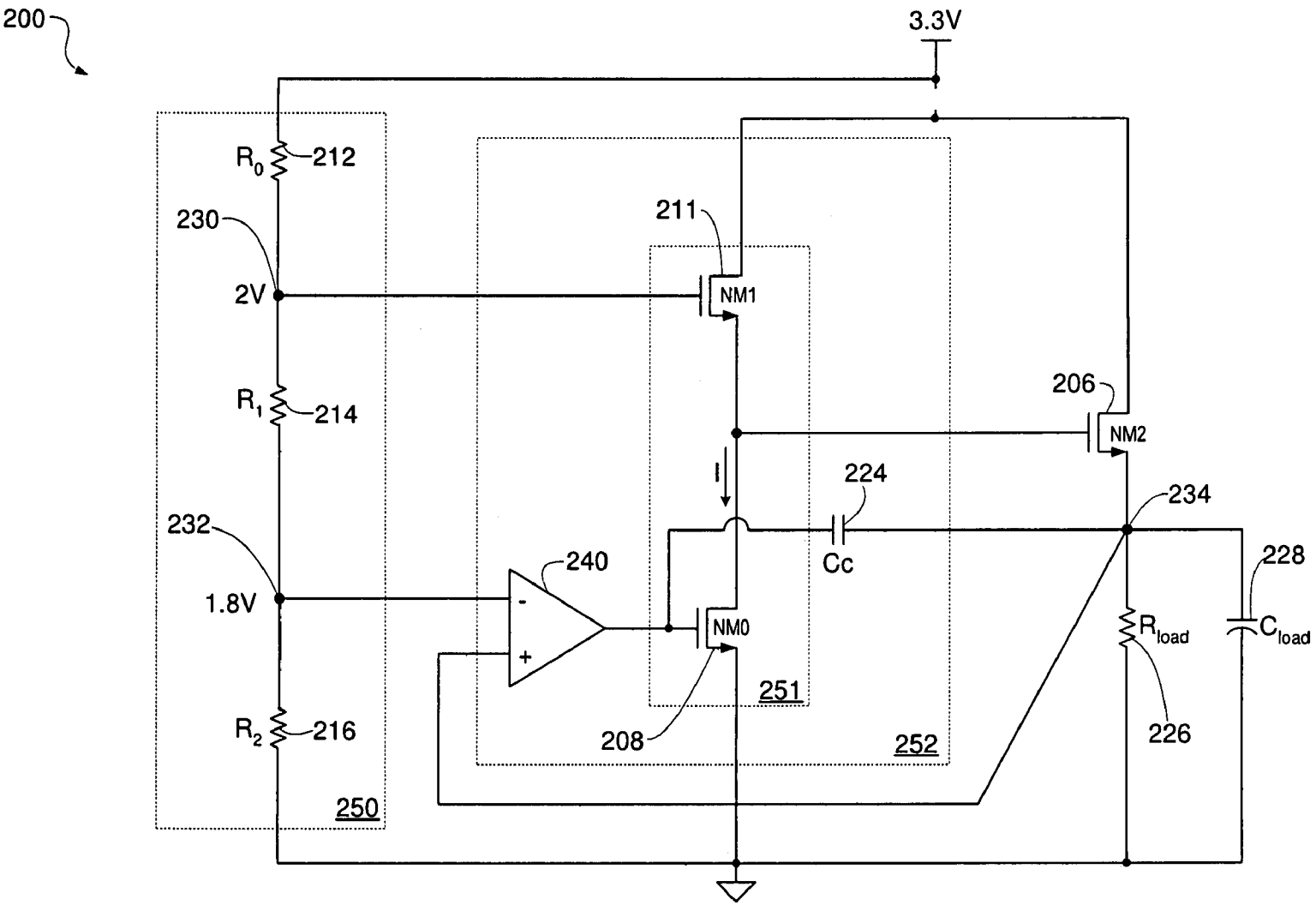
FIG. 2 shows an alternate embodiment of a voltage regulator with inherent clamping.

FIG. 2 shows an alternate embodiment 200 of a voltage regulator configured according to the principles described above. Voltage regulator 200 is similar to voltage regulator 100, but with the difference of omitting NMOS device 210, and replacing the current mirror (comprising PMOS devices 202 and 204) with NMOS device 211, as shown. Resistors 218, 220, and 222 have also been removed in this embodiment. Most notably, voltage regulator 200 eliminates potentially error producing current ΔI (shown in FIG. 1). As shown in FIG. 2, the gate of output NMOS transistor 206 may be driven by the source of NMOS device 211. In one embodiment, NMOS device 211 is a native device, thus the voltage at its source terminal is approximately equal to its gate voltage when current 'I' is very small, e.g. less than a certain amount of mA. In other words, the threshold voltage $V_{th}$ of NMOS device 211 may be approximately zero, e.g. less than certain amount of mV at a very low current 'I', also resulting in no current flowing into node 230 and effectively clamping the output voltage (at node 234) to the voltage that is generated at node 230. Accordingly, the gate to source voltage $V_{GS}$ of NMOS device 211 may increase as current 'I' increases.

As shown in FIG. 2, NMOS devices 211 and 208 may form an inverting amplifier 251 with the input of inverting amplifier 251 being the gate of NMOS device 208, driven in this case by the output of amplifier 240, and the output of inverting amplifier 251 being the source of NMOS device 211. The gain of inverting amplifier 251 may be expressed as $$\text{gain} = \frac{gm(NM0)}{gm(NM1)}, \tag{1}$$

where 'gm' is the transconductance of the specified NMOS device. The source terminal of NMOS device 206 may be configured as the output of voltage regulator 200, and coupled to the non-inverting input of amplifier 240, which may be an OTA, thereby creating feedback loop control. The output of amplifier 240 may be coupled to drive the gate of NMOS device 208. As the gate voltage of NMOS device 208 increases, the source voltage of NMOS device 211 may decrease, resulting in control of the gate of output NMOS device 206, and hence the source voltage of NMOS device 206 at node 234.

Although the embodiments above have been described in considerable detail, other versions are possible. Numerous variations and modifications will become apparent to those skilled in the art once the above disclosure is fully appreciated. It is intended that the following claims be interpreted to embrace all such variations and modifications. Note the section headings used herein are for organizational purposes only and are not meant to limit the description provided herein or the claims attached hereto.

I claim:

1. A voltage regulator comprising:

voltage divider circuitry operable to generate a first voltage from a supply voltage;

an output transistor having a control terminal, a second channel terminal configured as an output of the voltage regulator, and a first channel terminal configured to receive the supply voltage; and control circuitry having a first terminal coupled to the voltage divider to receive the first voltage, a second terminal coupled to the control terminal of the output transistor, and a third terminal coupled to the output of the voltage regulator to form a feedback loop;

wherein the control circuitry is operable, via the feedback loop, to maintain the first voltage at the output of the voltage regulator; and wherein the control circuitry is operable to control the output transistor via the second terminal, to prevent the output of the voltage regulator from rising above a specified voltage that is lower than the supply voltage, even at a time the voltage regulator is turned on and/or powered up.

2. The voltage regulator of claim 1, wherein the control circuitry is operable to clamp the output of the voltage regulator to the specified voltage without requiring any additional feedback loops and/or external capacitors.

3. The voltage regulator of claim 1, wherein the voltage divider circuitry is operable to generate the specified voltage, wherein the control circuitry comprises a fourth terminal configured to receive the specified voltage, and wherein the control circuitry is configured to couple the specified voltage to the control terminal of the output transistor via the second terminal.

4. The voltage regulator of claim 3, wherein the control circuitry comprises an amplifier having an output coupled to the second terminal, wherein the first terminal is an inverting input of the amplifier, and wherein the third terminal is a non-inverting input of the amplifier.

5. The voltage regulator of claim 4, wherein the control circuitry comprises a first pair of transistors with respective control terminals coupled to each other, wherein the output of the amplifier is coupled to the respective control terminals of the first pair of transistors, wherein a first channel terminal of a first one of the first pair of transistors is configured as the second terminal, and wherein the first pair of transistors is configured to have the value of a first current flowing into the first channel terminal of the first one of the first pair of transistors match the value of a second current flowing into a first channel terminal of the second one of the first pair of transistors.

6. The voltage regulator of claim 5, wherein the control circuitry comprises a second pair of transistors with respective control terminals coupled to each other, wherein a second channel terminal of a first one of the second pair of transistors is coupled to the first channel terminal of the first one of the first pair of transistors, wherein a second channel terminal of the second one of the second pair of transistors is coupled to the first channel terminal of the second one of the first pair of transistors, and wherein the first one of the second pair of transistors is configured to mirror current conducted by the first one of the second pair of transistors.

7. The voltage regulator of claim 6, wherein the second channel terminal of the first one of the second pair of transistors is configured as the fourth terminal, and wherein the control circuitry comprises a first resistor coupled between the fourth terminal and the second terminal.

8. The voltage regulator of claim 4, wherein the control circuitry further comprises a compensation capacitor coupled between the output of the amplifier and the output of the voltage regulator to reduce or remove oscillations at the output of the voltage regulator.

9. The voltage regulator of claim 1, wherein the voltage regulator is configured on an integrated circuit.

10. The voltage regulator of claim 1, wherein the voltage divider circuitry comprises resistors coupled in series between the supply voltage and ground, wherein a first node between a first and a second of the resistors is configured to provide the specified voltage, and wherein a second node between the second and a third of the resistors is configured to provide the first voltage.

11. A voltage regulator comprising:

a first circuit operable to generate a first voltage from a first supply voltage, wherein the first voltage is a portion of the supply voltage;

a controllable output device having a control terminal, a second channel terminal configured as an output of the voltage regulator, and a first channel terminal configured to receive the first supply voltage; and a second circuit having a first terminal coupled to the first circuit to receive the first voltage, a second terminal coupled to the control terminal of the controllable output device, and a third terminal coupled to the output of the voltage regulator to form a feedback loop;

wherein the second circuit is operable, via the feedback loop, to maintain the first voltage at the output of the voltage regulator; and wherein the first circuit is operable to control the controllable output device via the second terminal, to prevent the output of the voltage regulator from rising above a specified voltage that is lower than the first supply voltage, even at a time the voltage regulator is turned on and/or powered up, without requiring an additional feedback loop and/or an external bypass capacitor.

12. The voltage regulator of claim 11, wherein the specified voltage is greater than the first voltage.

13. The voltage regulator of claim 11, wherein the controllable output device is a first NMOS transistor, wherein the control terminal is a gate of the first NMOS transistor, the output terminal is a source of the first NMOS transistor and the input terminal is a drain of the first NMOS transistor.

14. The voltage regulator of claim 11, wherein the first circuit comprises resistors coupled in series between the first supply voltage and a second supply voltage lower than the first supply voltage, wherein a first node between a first and a second of the resistors is configured to provide the specified voltage, and wherein a second node between the second and a third of the resistors is configured to provide the first voltage.

15. The voltage regulator of claim 14, wherein the second circuit comprises a fourth terminal coupled to the first circuit to receive the specified voltage, and wherein the second circuit is configured to couple the specified voltage to the control terminal of the first NMOS transistor via the second terminal.

16. The voltage regulator of claim 15, wherein the second circuit comprises an operational transconductance amplifier (OTA) having an output coupled to the second terminal to control the gate of the first NMOS transistor, wherein the first terminal is an inverting input of the OTA, and wherein the third terminal is a non-inverting input of the OTA.

17. The voltage regulator of claim 16, wherein the second circuit further comprises second and third NMOS transistors, wherein a drain of the second NMOS transistor is coupled to the first supply voltage, a source of the third NMOS transistor is coupled to the second supply voltage, and a source of the second NMOS transistor is coupled to a drain of the third NMOS transistor to form the second terminal, wherein the output of the OTA is coupled to a gate of the third transistor.

18. The voltage regulator of claim 17, wherein a gate of the second transistor is the fourth terminal.

19. The voltage regulator of claim 11, wherein the second circuit further comprises a filter component configured between the output of the OTA and the output of the voltage regulator to reduce or remove oscillations at the output of the voltage regulator.

20. A voltage regulator comprising:

a first NMOS device having a gate, a drain coupled to a supply voltage, and a source coupled to an output node of the voltage regulator;

a second NMOS device having a drain coupled to the supply voltage, a gate configured to reside at a first voltage, and a source configured to drive the gate of the first NMOS device;

a third NMOS device having a gate, a drain coupled to the source of the second NMOS device, and a source coupled to a voltage reference; and an amplifier having a first input configured to reside at a second voltage, a second input coupled to the output node of the voltage regulator, and an output configured to drive the gate of the third NMOS device;

wherein the first NMOS device, the third NMOS device, and the amplifier together operate to maintain a voltage at the output node of the voltage regulator at a same level as the second voltage, after turn on of the voltage regulator; and wherein the second NMOS device operates to prevent the voltage at the output node of the voltage regulator from rising above a same level as the first voltage.

21. The voltage regulator of claim 20, further comprising a capacitor coupled between the output of the amplifier and the output node of the voltage regulator to reduce or eliminate oscillations at the output node of the voltage regulator.

22. The voltage regulator of claim 20, further comprising:

a load resistance coupled between the output node of the voltage regulator and the voltage reference; and load capacitance between the output node of the voltage regulator and the voltage reference.

23. The voltage regulator of claim 20, wherein the first input of the amplifier is a an inverting input and the second input of the amplifier is a non-inverting input.

24. The voltage regulator of claim 20, further comprising a voltage generating circuit configured to generate the first voltage and the second voltage.

25. The voltage regulator of claim 24, wherein the voltage generating circuit comprises first, second, and third resistors, each resistor having two ends;

wherein one end of the first resistor is coupled to the supply voltage and the other end of the first resistor is coupled to the gate of the second NMOS device;

wherein one end of the second resistor is coupled to the gate of the second NMOS device and the other end of the second resistor is coupled to the first input of the amplifier; and wherein one end of the third resistor is coupled to the first input of the amplifier and the other end of the third resistor is coupled to the voltage reference.

* * * * *